US007582851B2

(12) United States Patent
Fishman et al.

(10) Patent No.: US 7,582,851 B2
(45) Date of Patent: Sep. 1, 2009

(54) GRADIENT INDUCTION HEATING OF A WORKPIECE

(75) Inventors: Oleg S. Fishman, Maple Glen, PA (US); Vladimir V. Nadot, Sicklerville, NJ (US)

(73) Assignee: Inductotherm Corp., Rancocas, NJ (US)

( * ) Notice: Subject to any disclaimer, the term of this patent is extended or adjusted under 35 U.S.C. 154(b) by 452 days.

(21) Appl. No.: 11/141,746

(22) Filed: Jun. 1, 2005

(65) Prior Publication Data

US 2006/0289494 A1 Dec. 28, 2006

(51) Int. Cl.
*H05B 6/04* (2006.01)

(52) U.S. Cl. ..... 219/660; 219/661; 219/671

(58) Field of Classification Search ..... 219/626, 219/627, 618, 665, 666, 667, 671
See application file for complete search history.

(56) References Cited

U.S. PATENT DOCUMENTS 3,886,342 A * 5/1975 Peters, Jr. ..... 219/626
6,248,984 B1 * 6/2001 Isoyama et al. ..... 219/603
6,815,649 B2 11/2004 Beer
2003/0035309 A1 2/2003 Nadot et al.
2004/0028111 A1 * 2/2004 Fishman et al. ..... 373/146

FOREIGN PATENT DOCUMENTS

DE 37 10085 A1 10/1988
DE 3710085 A1 10/1988
JP 2006344596 * 5/2006
WO 00/28787 A1 5/2000

* cited by examiner

*Primary Examiner*—Daniel L Robinson
(74) *Attorney, Agent, or Firm*—Philip O. Post

(57) ABSTRACT

An apparatus and process are provided for gradient induction heating or melting of a workpiece with a plurality of induction coils, each of the plurality of induction coils is connected to a power supply that may have a tuning capacitor connected across the input of an inverter. The plurality of induction coils are sequentially disposed around the workpiece. The inverter has a pulse width modulated ac power output that may be in synchronous control with the pulse width modulated ac power outputs of the other power supplies via a control line between the controllers of all power supplies.

17 Claims, 3 Drawing Sheets

GRADIENT INDUCTION HEATING OF A WORKPIECE

CROSS REFERENCE TO RELATED APPLICATIONS

Not applicable.

FIELD OF THE INVENTION

The present invention relates to controlled gradient induction heating of a workpiece.

BACKGROUND OF THE INVENTION

It is advantageous to heat certain workpieces to a temperature gradient along a dimension of the workpiece. For example a cylindrical aluminum workpiece, or billet, that undergoes an extrusion process is generally heated to a higher temperature throughout its cross section at the end of the billet that is first drawn through the extruder than the cross section at the opposing end of the billet. This is done since the extrusion process itself is exothermic and heats the billet as it passes through the extruder. If the billet was uniformly heated through its cross section along its entire longitudinal axis, the opposing end of the billet would be overheated prior to extrusion and experience sufficient heat deformation to make extrusion impossible.

One method of achieving gradient induction heating of an electrically conductive billet, such as an aluminum alloy billet along its longitudinal axis, is to surround the billet with discrete sequential solenoidal induction coils. Each coil is connected to an current source at supply line frequency (i.e. 50 or 60 Hertz). Current flowing through each solenoidal coil establishes a longitudinal flux field around the coil that penetrates the billet and inductively heats it. In order to achieve gradient heating along the billet's longitudinal axis, each coil in sequence from one end of the billet to the other generally supplies a smaller magnitude of current (power) to the coil. Silicon controlled rectifiers may be used in series with the induction coil to achieve adjustable currents in the sequence of coils.

Use of supply line frequency makes for a simple current source but limits the range of billet sizes that can be commercially heated in such an arrangement. Penetration depth (in meters) of the induction current is defined by the equation, $503(\rho/\mu F)^{1/2}$, where $\rho$ is the electrical resistively of the billet in $\Omega\cdot$m.; $\mu$ is the relative (dimensionless) magnetic permeability of the billet; and F is the frequency of the applied field. The magnetic permeability of a non-magnetic billet, such as aluminum, is 1. Aluminum at 500° C. has an electrical resistivity of 0.087 $\mu\Omega\cdot$meter. Therefore from the equation, with F equal to 60 Hertz, the penetration depth can be calculated as approximately 19.2 mm, or approximately 0.8-inch. Induction heating of a billet is practically accomplished by a "soaking" process rather than attempting to inductively heat the entire cross section of the billet at once. That is the induced field penetrates a portion of the cross section of the billet, and the induced heat is allowed to radiate (soak) into the center of the billet. Typically an induced field penetration depth of one-fifth of the cross sectional radius of the billet is recognized as an efficient penetration depth. Therefore an aluminum billet with a radius of 4 inches results in the optimal penetration depth of 0.8-inch with 60 Hertz current. Consequently the range of billet sizes that can be efficiently heated by induction with a single frequency is limited.

One objective of the present invention is to provide an apparatus and a method of gradient inductive heating of a billet with a frequency of current that can easily be changed for varying sizes of workpieces.

BRIEF SUMMARY OF THE INVENTION

In one aspect, the present invention is an apparatus for, and method of, gradient induction heating or melting of a workpiece with a plurality of induction coils. Each of the plurality of induction coils is connected to a power supply that may have a tuning capacitor across the input of the inverter. Each inverter has a pulse width modulated ac output that is in synchronous control with the pulse width modulated ac outputs of the other power supplies via a control line between all power supplies.

Other aspects of the invention are set forth in this specification and the appended claims.

BRIEF DESCRIPTION OF THE DRAWINGS

The figures, in conjunction with the specification and claims, illustrate one or more non-limiting modes of practicing the invention. The invention is not limited to the illustrated layout and content of the drawings.

DETAILED DESCRIPTION OF THE INVENTION

Figure 1:
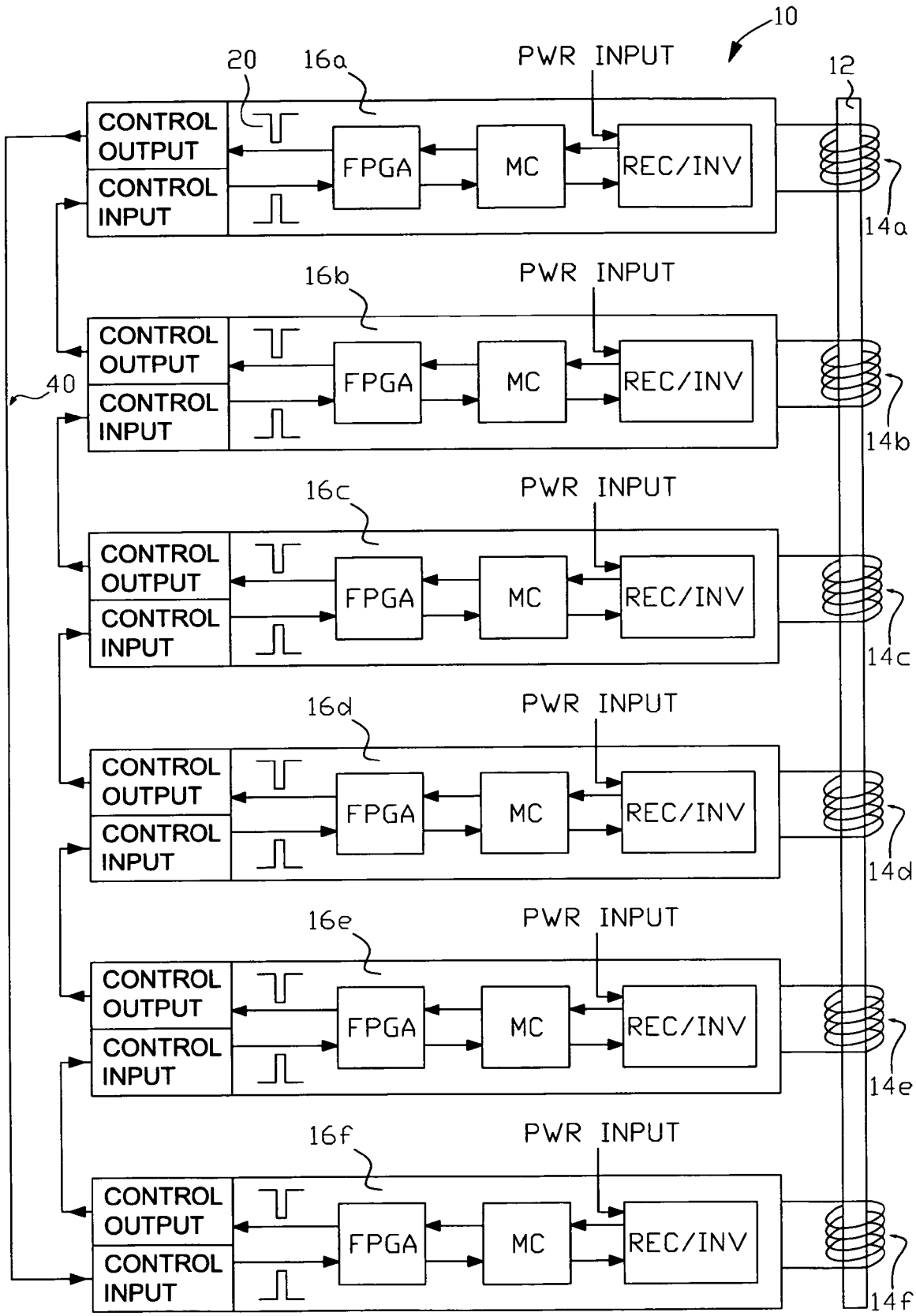
FIG. 1 is a simplified schematic illustrating one example of the gradient induction heating or melting apparatus of the present invention.

There is shown in FIG. 1 one example of the gradient induction heating apparatus 10 of the present invention. The workpiece in this particular non-limiting example, is billet 12. The dimensions of the billet in FIG. 1 are exaggerated to show sequential induction coils 14*a* through 14*f* around the workpiece. The workpiece may be any type of electrically conductive workpiece that requires gradient heating along one of its dimensions, but for convenience, in this specific example, the workpiece will be referred to as a billet and gradient heating will be achieved along the longitudinal axis of the billet. In other examples of the invention, the workpiece may be an electrically conductive material placed within a crucible, or a susceptor that is heated to transfer heat to another material. In these examples of the invention, the induction coils are disposed around the crucible or susceptor to provide gradient heating of the material placed in the crucible or the susceptor.

Induction coils 14*a* through 14*f* are shown diagrammatically in FIG. 1. Practically the coils will be tightly wound solenoidal coils and adjacent to each other with separation as required to prevent shorting between coils, which may be accomplished by placing a dielectric material between the coils. Other coil configurations are contemplated within the scope of the invention.

Figure 2:
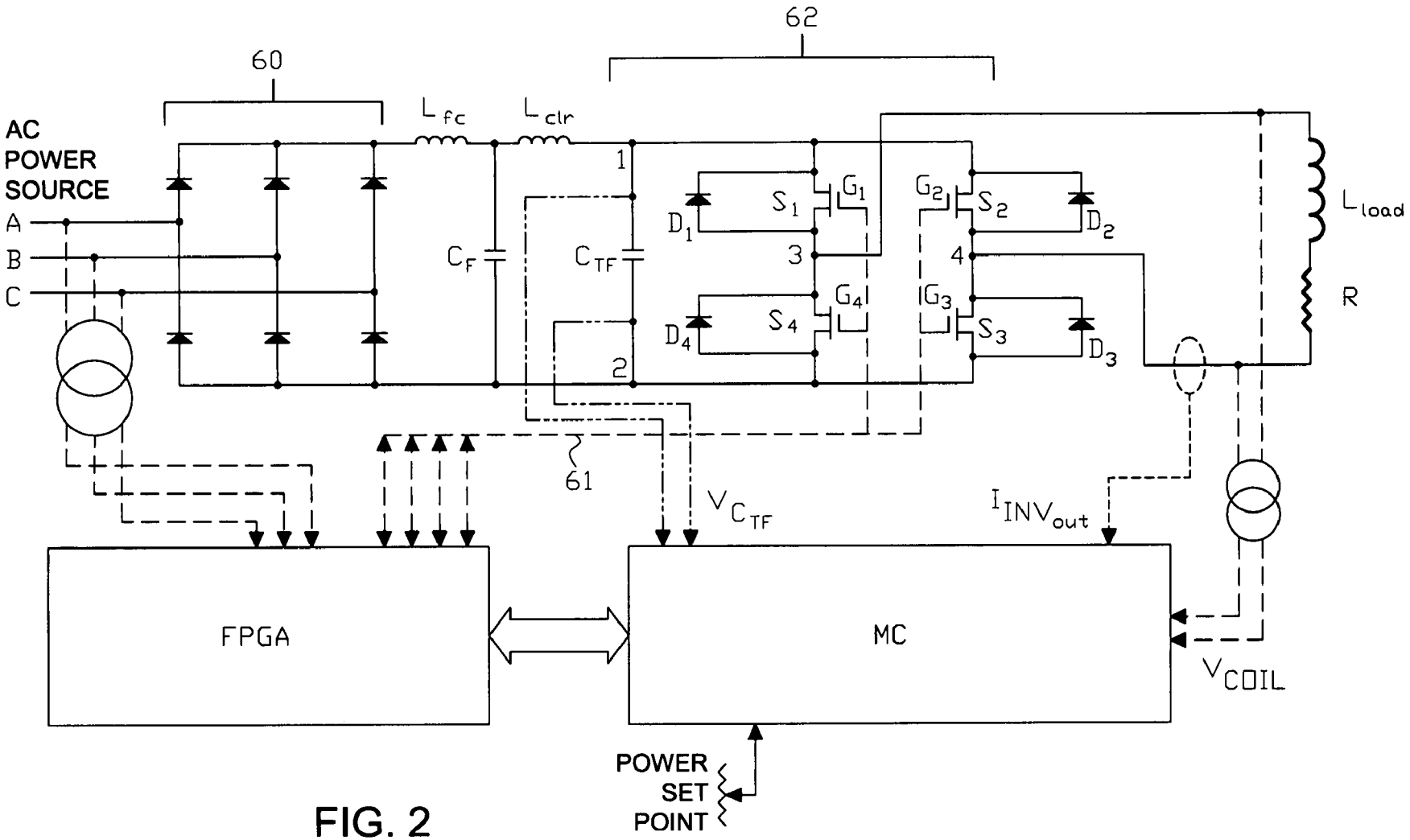
FIG. 2 is a simplified schematic illustrating one of the plurality of power supplies used in the gradient induction heating or melting apparatus of the present invention.

Pulse width modulated (PWM) power supplies 16*a* through 16*f* can supply different rms value currents (power) to induction coils 14*a* though 14*f*, respectively. Each power supply may include a rectifier/inverter power supply with a low pass filter capacitor ($C_F$) connected across the output of rectifier 60 and a tuning capacitor ($C_{TF}$) connected across the input of inverter 62 as shown in FIG. 2, and as disclosed in U.S. Pat. No. 6,696,770 titled Induction Heating or Melting Power Supply Utilizing a Tuning Capacitor, which is hereby incorporated by reference in its entirety. In FIG. 2, $L_{fc}$ is an optional line filter and $L_{clr}$ is a current limiting reactor. The output of each power supply is a pulse width modulated voltage to each of the induction coils.

FIG. 2 further illustrates the details of a typical power supply wherein the non-limiting power source (designated lines A, B and C) to each power supply is 400 volts, 30 Hertz. Inverter 62 comprises a full bridge inverter utilizing IGBT switching devices. In other examples of the invention the inverter may be otherwise configured such as a resonant inverter or an inverter utilizing other types of switching devices. Microcontroller MC provides a means for control and indication functions for the power supply. Most relevant to the present invention, the microcontroller controls the gating circuits for the four IGBT switching devices in the bridge circuit. In this non-limiting example of the invention the gating circuits are represented by a field programmable gate array (FPGA), and gating signals can be supplied to the gates G1 through G4 by a fiber optic link (indicated by dashed lines 61 in FIG. 2). The induction coil connected to the output of power supply shown in FIG. 2 is represented as load coil $L_{load}$. Coil $L_{load}$ represents one of the induction coils 14*a* through 14*f* in FIG. 1. The resistive element, R, in FIG. 2 represents the resistive impedance of heated billet 12 that is inserted in the billet, as shown in FIG.1.

Figure 3:
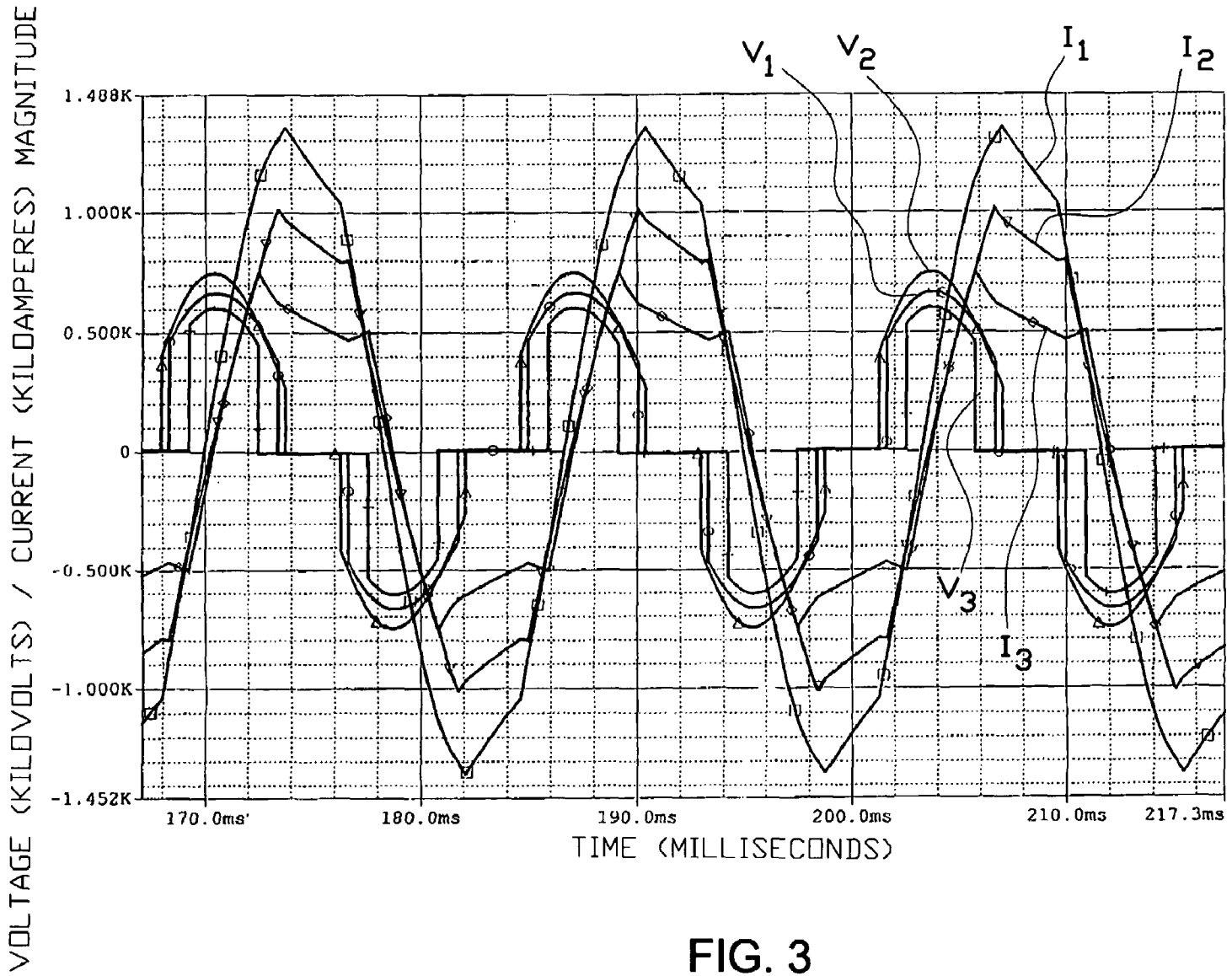
FIG. 3 is a graph illustrating typical results in load coil currents for variations in inverter output voltages for one example of the gradient induction heating or melting apparatus of the present invention.

In operation the inverter's pulse width modulated output of each power supply 16*a* through 16*f* can be varied in duration, phase and/or magnitude to achieve the required degree of gradient induction heating of the billet. FIG. 3 is a typical graphical illustration of variations in the voltage outputs ($V_1$, $V_2$ and $V_3$) from the power supplies for three adjacent induction coils that result in load coil currents $I_1$, $I_2$ and $I_3$, respectively. Desired heating profiles can be incorporated into one or more computer programs that are executed by a master computer communicating with the microcontroller in each of the power supplies. The induction coils have mutual inductance; to prevent low frequency beat oscillations all coils should operate at substantially the same frequency. In utilizing the flexibility provided by the use of inverters with pulse width modulated outputs, all inverters are synchronized. That is, the output frequency and phase of all inverters are, in general, synchronized.

While energy flows from the output of each inverter to its associated induction coil two diagonally disposed switching devices (e.g., $S_1$ and $S_3$, or $S_2$ and $S_4$ in FIG. 2) are conducting and voltage is applied across the load coil. At other times the coil is shorted and current is flowing via one switching device and an antiparallel diode (e.g., $S_1$ and $D_2$; $S_2$ and $D_1$; $S_3$ and $D_4$; or $S_4$ and $D_3$ in FIG. 2. This minimizes pickup of energy from adjacent coils.

Referring back to FIG. 1, synchronous control of the power outputs of the plurality of power supplies is used to minimize circuit interference between adjacent coils. Serial control loop 40 represents a non-limiting means for synchronous control of the power outputs of the plurality of power supplies. In this non-limiting example of the invention serial control loop 40 may comprise a fiber optic cable link (FOL) that serially connects all of the power supplies. Control input (CONTROL INPUT in FIG. 1) of the control link to each power supply may be a fiber optic receiver (FOR) and control output (CONTROL OUTPUT in FIG. 1) of the control link from each power supply may be a fiber optic transmitter (FOT). One of the controllers of the plurality of power supplies, for example the controls of power supply 16*a* is programmably selected as the master controller. The CONTROL OUTPUT of the master controller of power supply 16*a* outputs a normal synchronization pulse 20 to the CONTROL INPUT of the slave controller of power supply 16*f*. If slave controller of power supply 16*f* is in a normal operating state, it passes the normal synchronization pulse to the slave controller of power supply 16*e*, and so on, until the normal synchronization pulse is returned to the CONTROL INPUT of the master controller of power supply 16*a*. In addition each controller generates an independent pulse width modulated ac output power for each inverter in the plurality of power supplies. In the event of an abnormal condition in any one of the power supplies, the effected controller can output an abnormal operating pulse to the controller of the next power supply. For example while a normal synchronization pulse may be on the order of 2 microseconds, an abnormal operating pulse may be on the order of 50 microseconds. Abnormal operating pulses are processed by the upstream controllers of power supplies to shutdown or modify the induction heating process. Generally the time delay in the round trip transmission of the synchronization pulse from and to the master controller is negligible. In the event of failure of one of the controllers, a synchronizing signal will not return to the master controller, which will result in the execution of an abnormal condition routine, such as stopping subsequent normal synchronization pulse generation.

In the above non-limiting example of the invention six power supplies and induction coils are used. In other examples of the invention other quantities of power supplies and coils may be used without deviating from the scope of the invention.

The examples of the invention include reference to specific electrical components. One skilled in the art may practice the invention by substituting components that are not necessarily of the same type but will create the desired conditions or accomplish the desired results of the invention. For example, single components may be substituted for multiple components or vice versa.

The foregoing examples do not limit the scope of the disclosed invention. The scope of the disclosed invention is further set forth in the appended claims.

The invention claimed is:

1. Apparatus for gradient induction heating or melting of a workpiece, the apparatus comprising:

a plurality of induction coils sequentially disposed around the workpiece;

a separate power supply for each one of the plurality of induction coils, each separate power supply comprising an inverter having an adjustable pulse width modulated ac output connected to its associated induction coil; and a control line connected between the power supplies to synchronously control the pulse width modulated ac outputs of the power supplies.

2. The apparatus of claim 1 wherein at least one of the inverters has a tuning capacitor across the input of the inverter.

3. The apparatus of claim 1 wherein the plurality of induction coils are tightly wound solenoid induction coils and disposed adjacent to each other with dielectric separation to prevent shorting between adjacent coils.

4. The apparatus of claim 1 wherein the workpiece comprises electrically conductive material placed within a crucible.

5. The apparatus of claim 1 wherein the workpiece comprises a susceptor.

6. Apparatus for gradient induction heating or melting of a workpiece, the apparatus comprising:

two or more induction coils sequentially disposed around the workpiece;

an inverter for each one of the two or more induction coils, each of the inverters comprising at least four solid state switching devices, each of the inverters having a pulse width modulated ac output connected to its associated induction coil;

a controller associated with each of the inverters to control the inverter's switching devices; and a control line connected between the inverters to synchronously control the outputs of the inverters.

7. The apparatus of claim 6 wherein at least one of the inverters has a tuning capacitor across the input of the inverter.

8. The apparatus of claim 6 wherein the plurality of induction coils are tightly wound solenoid induction coils and adjacent to each other with dielectric separation to prevent shorting between adjacent coils.

9. The apparatus of claim 6 wherein the workpiece comprises electrically conductive material placed within a crucible.

10. The apparatus of claim 6 wherein the workpiece comprises a susceptor.

11. The apparatus of claim 6 wherein the controller controls the inverter switching devices to short circuit the one of the two or more induction coils associated with the inverter when power is not being supplied to the one of the two or more induction coils associated with the inverter.

12. Apparatus for gradient induction heating or melting of a workpiece, the apparatus comprising:

two or more induction coils sequentially disposed around the workpiece;

an inverter for each one of the two or more induction coils, each of the inverters comprising at least four solid state switching devices, each of the inverters having a pulse width modulated ac output connected to its associated induction coil, each of the inverters having a tuning capacitor across the input of the inverter;

a controller associated with each of the inverters to control the inverter's switching devices; and a control line connected between the inverters to synchronously control the outputs of the inverters.

13. The apparatus of claim 12 wherein the controller controls the inverter switching devices to short circuit the one of the two or more induction coils associated with the inverter when power is not being supplied to the one of the two or more induction coils associated with the inverter.

14. The apparatus of claim 12 wherein at least one of the inverters has a tuning capacitor across the input of the inverter.

15. The apparatus of claim 12 wherein the plurality of induction coils are tightly wound solenoid induction coils and disposed adjacent to each other with dielectric separation to prevent shorting between adjacent coils.

16. The apparatus of claim 12 wherein the workpiece comprises electrically conductive material placed within a crucible.

17. The apparatus of claim 12 wherein the workpiece comprises a susceptor.

* * * * *